US006806861B1

(12) United States Patent
Sakaguchi et al.

(10) Patent No.: US 6,806,861 B1
(45) Date of Patent: Oct. 19, 2004

(54) REFERENCE GAMMA COMPENSATION VOLTAGE GENERATION CIRCUIT

(75) Inventors: Yoshitami Sakaguchi, Fujisawa (JP); Akihiko Mizutani, Zushi (JP)

(73) Assignee: International Business Machines Corporation, Armonk, NY (US)

( * ) Notice: Subject to any disclaimer, the term of this patent is extended or adjusted under 35 U.S.C. 154(b) by 64 days.

(21) Appl. No.: 09/698,458

(22) Filed: Oct. 27, 2000

(30) Foreign Application Priority Data

Oct. 27, 1999 (JP) ..... 11-305185
Dec. 1, 1999 (JP) ..... 11-342221

(51) Int. Cl.[7] ..... G09G 3/36
(52) U.S. Cl. ..... 345/100; 345/89; 345/589
(58) Field of Search ..... 345/204, 89, 100, 345/691, 87, 589, 92, 90

(56) References Cited

U.S. PATENT DOCUMENTS 5,739,803 A * 4/1998 Neugebauer ..... 345/100
5,796,384 A * 8/1998 Kim ..... 345/87
5,929,835 A * 7/1999 Sakamoto ..... 345/589
6,061,046 A * 5/2000 An ..... 345/100
6,160,532 A * 12/2000 Kaburagi et al. ..... 345/87
6,160,533 A * 12/2000 Tamai et al. ..... 345/89
6,239,780 B1 * 5/2001 Walker et al. ..... 345/102
6,335,716 B1 * 1/2002 Yamazaki et al. ..... 345/92
6,384,806 B1 * 5/2002 Matsueda et al. ..... 345/691

* cited by examiner

*Primary Examiner*—Chanh Nguyen
*Assistant Examiner*—Uchendu O. Anyaso
(74) *Attorney, Agent, or Firm*—Scully, Scott, Murphy & Presser; Robert M. Trepp, Esq.

(57) ABSTRACT

The object of the present invention is to reduce the number of inputs to LCD driver chips, and to suppress the occurrence of variances between the chips.

A ten bit wide binary counter 202 is self activated in synchronization with a system clock. Each of multiple five-step shift registers 200 having ten bit widths stores gamma compensation data received from a PC. Each of multiple comparators 204 compares a binary counter value (X) with a value (Y) stored in a ten bit wide five-step shift register 200, and converts the gamma compensation data into a pulse width. The output of each comparator 204 is latched by each of multiple D-FFs 206 in synchronization with the system clock, and each of multiple time/voltage converters 208 passes the output of a D-FF 206 through an LPF and generates a reference gamma compensation voltage.

5 Claims, 13 Drawing Sheets

1

| D I O | S T B | Operation |
|---|---|---|
| 0 | 0 | None |
| 0 | 1 | Normal STB operation |
| 1 | 0 | Normal DIO operation |
| 1 | 1 | Begin transmission of gamma compensation data |

REFERENCE GAMMA COMPENSATION VOLTAGE GENERATION CIRCUIT

BACKGROUND OF THE INVENTION

The present invention relates to a reference gamma compensation voltage generation circuit for an LCD source driver.

PRIOR ART

In a conventional LCD source driver, a reference gamma compensation voltage generated by an external circuit is supplied to driver chips. Of the source drivers that are presently in use, one employs a resistor array to reduce the number of inputs to the driver chips. However, due to resistance variations, reference voltage differences appear between the driver chips, and to compensate for this while employing the reference voltage, all the driver chips are mutually interconnected. Thus, the original object, the reduction in the number of driver chip inputs, is not achieved, and furthermore, since the gamma characteristic that is to be compensated for is fixed, a source driver must be specifically prepared for each LCD panel.

To resolve the above conventional shortcoming, it is one object of the present invention to provide a reference gamma compensation voltage generation circuit that, to generate a reference gamma compensation-voltage, employs an internal circuit to reduce the number of inputs to an LCD driver chip, and that, when multiple LCD driver chips are employed, can reduce the incidence of resistance variations among these chips.

SUMMARY OF THE INVENTION

According to a first aspect of the present invention, to achieve the above object a reference gamma compensation voltage generation circuit comprises: a counter, for system clocks, that generates a clock count value; a register, for storing a gamma compensation function value that is set, after the power is turned on; signal generation means, for employing the clock count value and the gamma compensation function value to generate a PWM signal wherein, for each gamma compensation cycle, the gamma compensation function value is represented as a pulse width; and a voltage generation circuit, for employing the PWM signal to generate a reference gamma compensation voltage.

It is preferable that the signal generation means compare the clock count value with the gamma compensation function value-to generate-the PWM signal.

It is also preferable that the voltage generation circuit filter the PWM signal to generate the gamma compensation function value.

In addition, according to a second aspect of the present invention, to achieve the above object a reference gamma compensation voltage generation circuit comprises: a counter, for generating a count value that represents a gamma compensation cycle; a register, for storing a gamma compensation function value that is set after the power is turned on; signal generation means, for employing the count value and the gamma compensation-function value to generate a PDM signal that represents the gamma compensation function value as the number of pulses for each gamma compensation cycle; and a voltage generation circuit, for employing the PDM signal to generate a reference gamma compensation voltage.

It is preferable that the voltage generation circuit filter the PDM signal to generate the gamma compensation function value.

BRIEF DESCRIPTION OF THE DRAWINGS

Preferred embodiments of the present invention will now be described, by way of example only, with reference to the accompanying drawings in which.

DETAILED DESCRIPTION OF THE PREFERRED EMBODIMENTS OF THE INVENTION

The present invention employs, as a premise, a process such as SiGe-BiCMOS technology for enabling fast processing.

Figure 1:
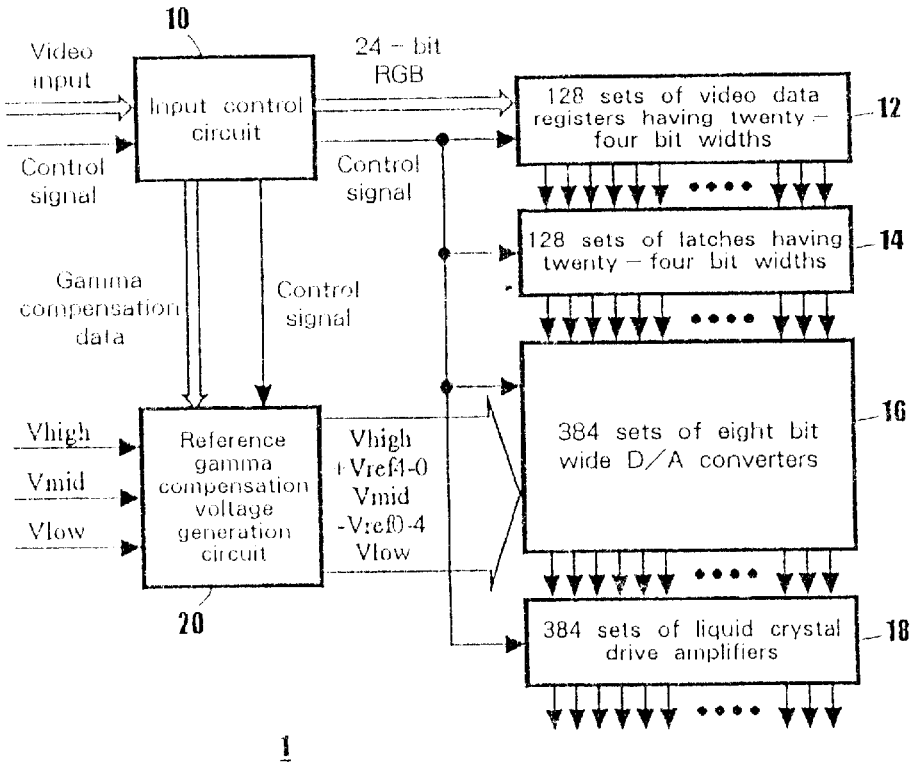
FIG. 1 is a diagram showing the arrangement of a 8-bit scale and 384-output LCD source driver according to the present invention.

FIG. 1 is a diagram showing the arrangement of an 8-bit gray scale, 384-output, LCD source driver 1, for which the present invention is applied. An input control circuit 10 and a reference gamma compensation voltage generation circuit 20 in FIG. 1 constitute the present invention; the other sections (a video data register 12, a latch 14, an 8-bit D/A converter 16 and a liquid crystal driving amplifier 18) are the essential components of the LCD source driver.

The input control circuit 10 receives video data and a control signal. When these video data are RGB data, the input control circuit 10 transmits them to the video data register 12, where they are temporarily stored. When, however, the video data are gamma compensation data, the input control circuit 10 transmits them to the reference gamma compensation voltage generation circuit 20.

The gamma compensation data, which can be received in an arbitrary blanking period of time, are employed by the reference gamma compensation voltage generation circuit 20 to generate a required reference voltage.

In FIG. 1, a reference voltage for gamma compensation is generated at 10 levels, ±Vref0 to Vref4. The terms Vhigh, Vmid and Vlow denote a liquid crystal driving voltage, a common voltage (common electrode voltage) and a liquid crystal driving voltage GND.

The 8-bit D/A converter 16 employs the reference gamma compensation voltage to perform gamma compensation for video data that are stored in the latch 14 and to convert the video data into an analog voltage.

The reference gamma compensation voltage generation circuit 20 generates a reference voltage by passing a sequence of pulses through a low-pass filter and generating a direct-current voltage. The pulse width modulation (PWM) system, the pulse density modulation (PDM) system or the sigma delta modulation (SDM) system can be employed as the pulse control system.

To implement this system only a simple circuit is required. And while a large value must be set for the resistors R and the capacitors C that constitute the low-pass filter, a constant noise level in consonance with a generated reference voltage can be maintained.

When the same operation as that provided by the PWM system is implemented, the value set for the resistors R and the capacitors C that constitute the low-pass filter can be reduced to approximately 1/10 that set for the PWM system.

This system can be effectively employed for chip size reduction.

Using noise shaping, the value set for the resistors R and the capacitors C that constitute the low-pass filter can be reduced even more than for the PDM system. However, in this case the chip size is increased because a multiple-bit calculation circuit (an 11-bit adder for ten bit precision gamma compensation) is required.

While taking into account the reference voltage generation circuit that is incorporated in an LCD source driver, the present invention implements the reference voltage generation circuit 20 that employs the PWM system and the PDM system, neither of which require a calculation circuit. Since this reference voltage generation circuit 20 is designed to serve as a dedicated LCD driver, it can generate voltages that are symmetrical to an LCD common voltage. Furthermore, since a plurality of LCD source drivers are employed for a single LCD panel, between the chips, variances in the reference voltage must be suppressed. The problem this presents is resolved by employing the characteristic of the LCD panel whereby a satisfactory setup time can be obtained until the reference voltage is established, and by absorbing the variances in the process performed along the time axis. When the circuit of this invention is applied for an LCD source driver that has been developed for a COG & WOA LCD panel, the probability that the COG & WOA LCD panel will be implemented is considerably increased. The reference voltage generation circuit 20 that is implemented by the PWM and PDM systems will now be described.

Figure 2:
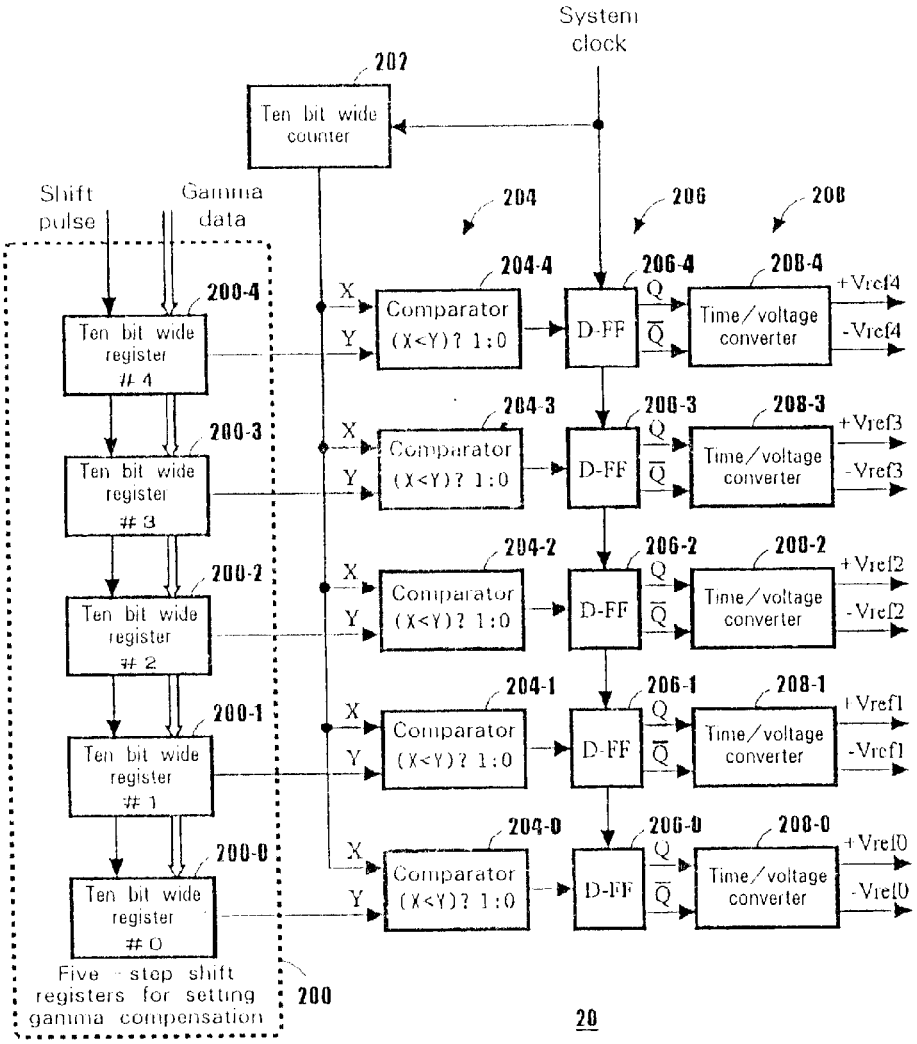
FIG. 2 is a diagram showing the arrangement of a reference voltage generation circuit.

FIG. 2 is a diagram illustrating the arrangement of the reference voltage generation circuit 20. In FIG. 2, the gamma compensation is performed with ten bit precision. When, for example, ±5 V is to be used to drive liquid crystal, a reference voltage of 5000 [mV]/1024=4.9 [mV] can be set for gamma compensation.

This circuit 20 comprises: a binary counter 202 of 10 bits; five-step shift registers 200 (200-0 to 200-4) that have ten bit widths; comparators 204 (204-0 to 204-4) for handling ten bit wide binary data; D-FFs 206 (206-0 to 206-4); and time/voltage converters 208 (208-0 to 208-4).

The ten bit wide binary counter 202 is self activating and operates in synchronization with a system clock, a dot clock used in the LCD source driver, and about 65 MHz for an XGA panel.

A five-step shift register 200, which has a ten bit width, stores gamma compensation data received from a PC.

A comparator 204 repeatedly compares the value (X) of the ten bit wide binary counter 202 with the value (Y) stored in a ten bit wide five-step shift register 200. When a value X is found that is smaller than the value Y, the comparator 204 outputs a "1," and when a value X is found that is equal to or greater than the value Y, the comparator 204 outputs a "0." The comparator 204 converts the gamma compensation data into a pulse width, and synchronized with the system clock, its output is latched by the D-FF 206.

A D-FF 206 outputs Q, which is the unchanged input, and the inverted value of Q. Q and its inverted value are then transmitted to a time/voltage converter 208 where they are used to convert a pulse width into a voltage. Thereafter, the voltage output by the converter 208 is employed as a reference voltage for gamma compensation.

Sections other than the time/voltage converter 208 are constituted merely by digital circuits that are activated at a low voltage, so that the area on the chip occupied by the circuit and the power consumed by the circuit can both be reduced considerably.

Figure 3:
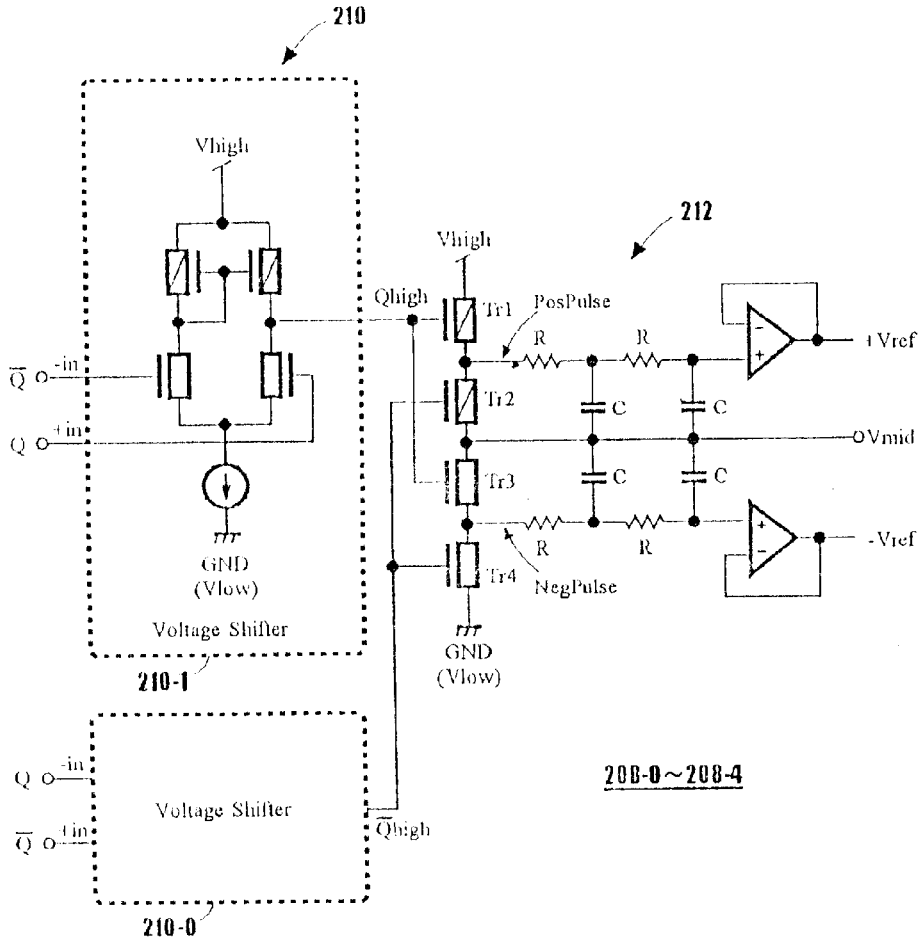
FIG. 3 is a diagram showing the arrangement of a time/voltage converter.

FIG. 3 is a diagram illustrating the arrangement of the time/voltage converter 208 (208-0 to 208-4).

As is shown in FIG. 3, the time/voltage converter 208 comprises: paired voltage shifters 210, 210-0 and 210-1, for shifting the voltage output by the D-FF 206; and a circuit 212, for generating two reference voltages (+Vref and −Vref) that are symmetrical to a common voltage Vmid. The voltage shifters 210 convert signals of 0 to Vcc (a power voltage for a digital circuit) to signals of 0 to Vhigh (a power voltage for driving liquid crystal).

The circuit 212 for generating the reference voltage converts a pulse of 0 to Vhigh into a pulse of 0 to Vmid and a pulse of Vmid to Vhigh. These two types of pulses are passed through the low-pass filter, which includes a resistor and a capacitor, and a direct-current voltage is generated. The direct-current voltage is then output through a buffer amplifier. The following notes refer to the implementation of the circuit 20.

For the circuit 20, a ten bit width is employed for the counter and for the registers. Optimization of the bit width is performed while taking into account a voltage required for the driving of liquid crystal and a required step voltage for a reference voltage setup.

When the gamma compensation curve must be approximated more precisely, the number of the reference voltage generation sections, each of which is constituted by ten bit wide five-step shift registers 200, comparators 204, D-FFs 206 and time/voltage converters 208, should be increased.

While for the circuit of this invention it is premised that the same gamma compensation (symmetric to Vmid) should be provided, by positive or negative writing to liquid crystal, if needed, the reference voltage generation section is separately provided for positive writing and for negative writing, so that asymmetric gamma compensation can be furnished to the positive and the negative sides.

In this case, while the number of ten bit wide five-step shift registers 200, comparators 204 and D-FFs 206 is doubled, for either section only one time/voltage converter 208 for generating +Vref or −Vref need be provided. Therefore, since the overall counts of the resistors (R) and the capacitors (C), which together account for most circuit size increases, can be equalized, increases in circuit size can be suppressed.

Since transistors Tr1, Tr2, Tr3 and Tr4, which are employed by the time/voltage converters 208, must output voltages at power levels (Vhigh, Vmid and Vlow), in this instance the use of FETs is appropriate.

For the time/voltage converter 208, the values of the resistors (R) and the capacitors (C), and the number of the resistor R and capacitor C steps that are required are determined while taking into account the frequency of an input pulse. When, for example, the system clock is 65 MHz, a pulse of approximately 63.5 KHz (65 MHz/1024) is input. At this time, when the resistance is 4 MΩ and the capacitance is 40 pF, the cutoff frequency is approximately 1 KHz, and the pulse can be converted into a direct-current voltage. If needed, the number of filters can be increased to four to reduce noise.

The precision of the reference voltage is not affected by the values of the resistors and the capacitors used here. Since the reference voltage is not affected when the R and C values in the driver chips differ due to variances in the process, and is affected only by the time that is required for its establishment, no particular problem arises.

FIGS. 4A to 4I are diagrams showing the operation of the reference voltage generation circuit 20. Only one reference voltage generation section is shown; however, the described procedures can also be applied for the other sections. The ten bit wide counter 202 repeats a 0 to 1023 count in synchronization with the system clock.

Figure 4:
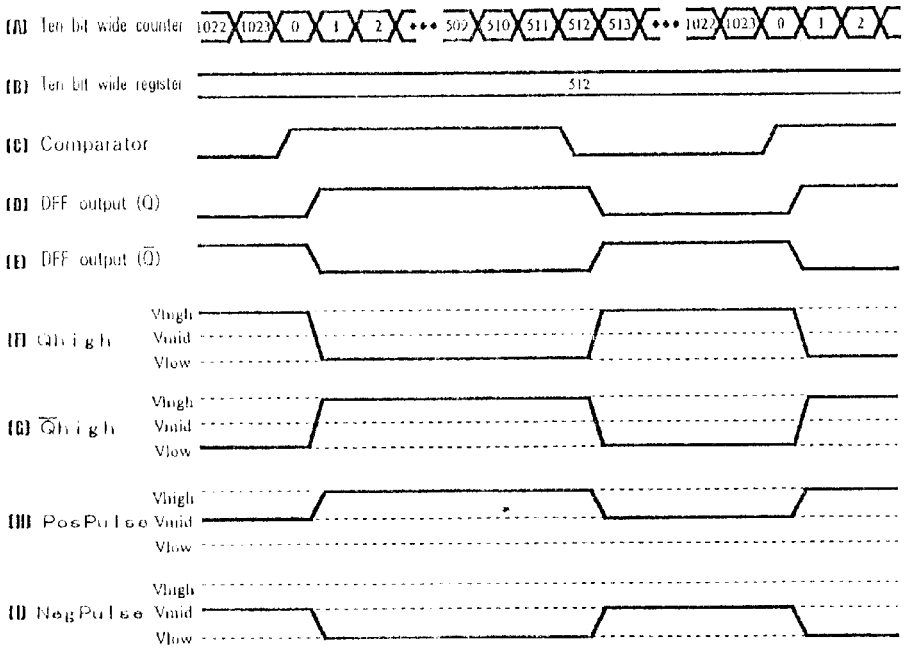
FIGS. 4A to 4I are charts showing the operation of the reference voltage generation circuit.

In FIG. 4B, it is assumed that 512 has been loaded into the ten bit wide register for gamma data compensation. At this time, the comparator 204 compares the count value with the register value, and its output is High during a period wherein the ten bit wide counter 202 value is smaller than the register counter value. The D-FF 206 latches the output of the comparator 204 in accordance with the system clock, and outputs the Q and the inverted value of Q.

The voltage widths of Q and its inverted value are shifted by the voltage shifter 210. This state is shown in FIG. 4F and 4G.

Figure 5:
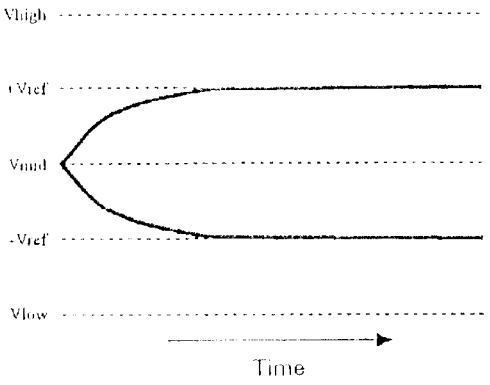
FIG. 5 is a diagram showing the condition where ±Vref is stabilized.

These signals are separated by the transistors Tr1 to Tr4 into a PosPulse having amplitudes Vmid to Vhigh, and a NegPulse having amplitudes Vmid to Vlow. The pulse widths of the PosPulse and the NegPulse correspond to the reference voltage that has been set. When these signals are converted into direct-current voltages based on Vmid, reference voltages (+Vref and −Vref) can be generated that are Vmid symmetric, and the voltages ±Vref become stable after several mS. This state is shown in FIG. 5.

Figure 6:
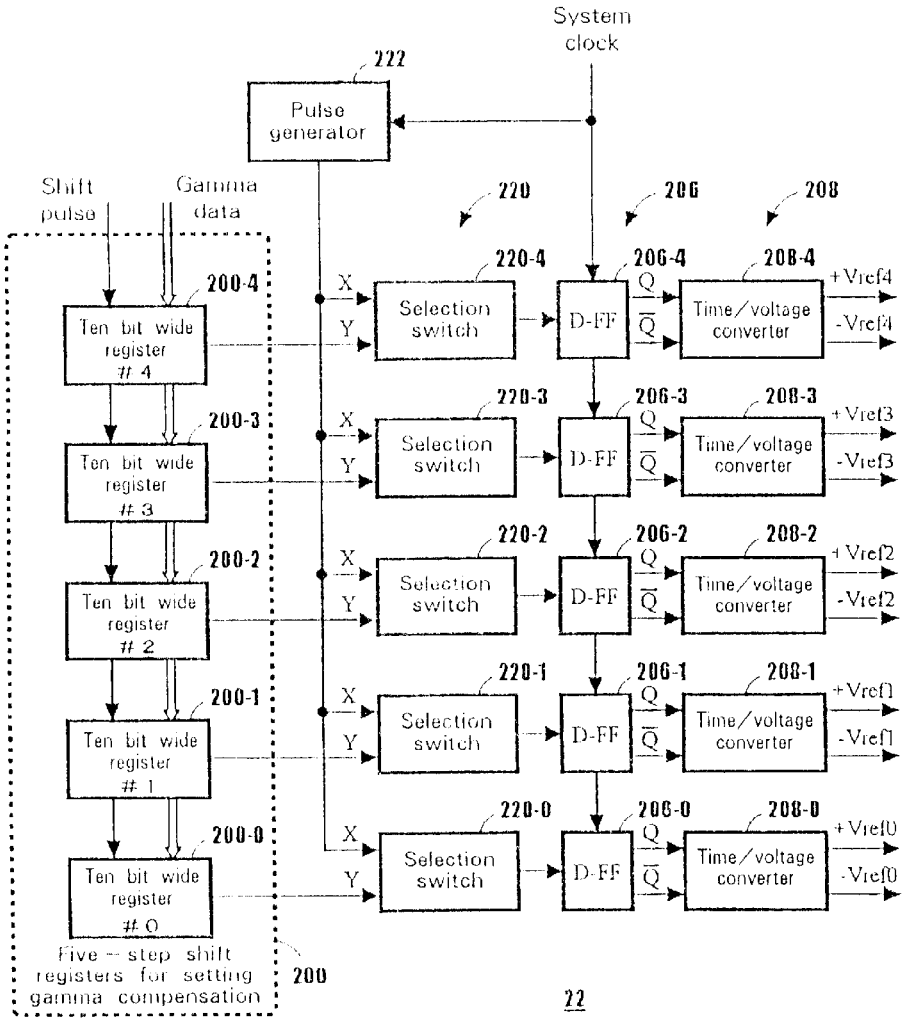
FIG. 6 is a diagram showing the circuit arrangement for a pulse density control system.

FIG. 6 is a circuit diagram for the pulse density modulation (PDM) system. Since this arrangement is similar to that of the PWM system, only the portions that differ will be described.

Figure 7:
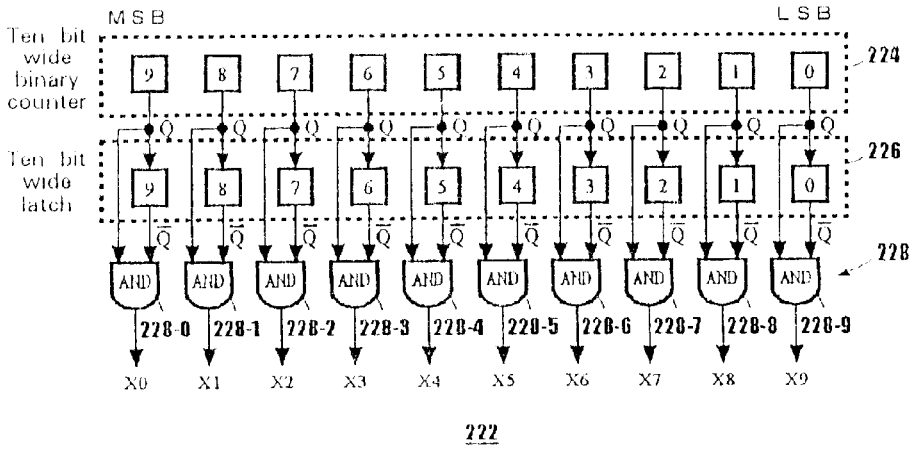
FIG. 7 is a diagram showing the arrangement of a pulse generator.

A pulse generator 222 is provided instead of the ten bit wide counter 202 in the PWM system, and as is shown in FIG. 7, is constituted by a ten bit wide binary counter 224, a ten bit wide latch 226 and ten AND gates 228 (228-0 to 228-9).

As in the PWM system, this circuit generates a ten bit precision reference voltage for gamma compensation. The ten bit wide binary counter 224 is self activated in synchronization with the system clock.

Figure 8:
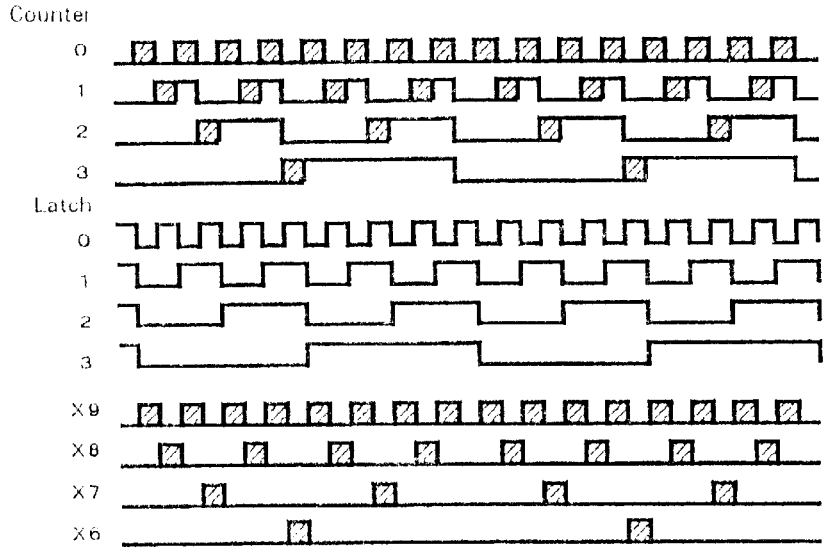
FIG. 8 is a diagram showing the process for generating X9 to X6.

The ten bit wide latch 226 stores a counter value obtained at a preceding clock, and when an AND of the positive logical output Q and the negative logical output of the counter 224 is obtained, a portion, equivalent to one clock period, that increases from 0 to 1 can be extracted from each bit in the counter 224. The ten thus obtained pulses X9 to X0 are generated exclusive of each other. The appearance frequency Pn for pulse Xn (n=9 to 0) is ($Pn=\frac{1}{2}^{10-n}$), and 1024 pulse densities can be provided by combining X9 to X0. The process for generating X9 to X6 is shown in FIG. 8. The same process is employed to generate X5 to X0.

Figure 9:
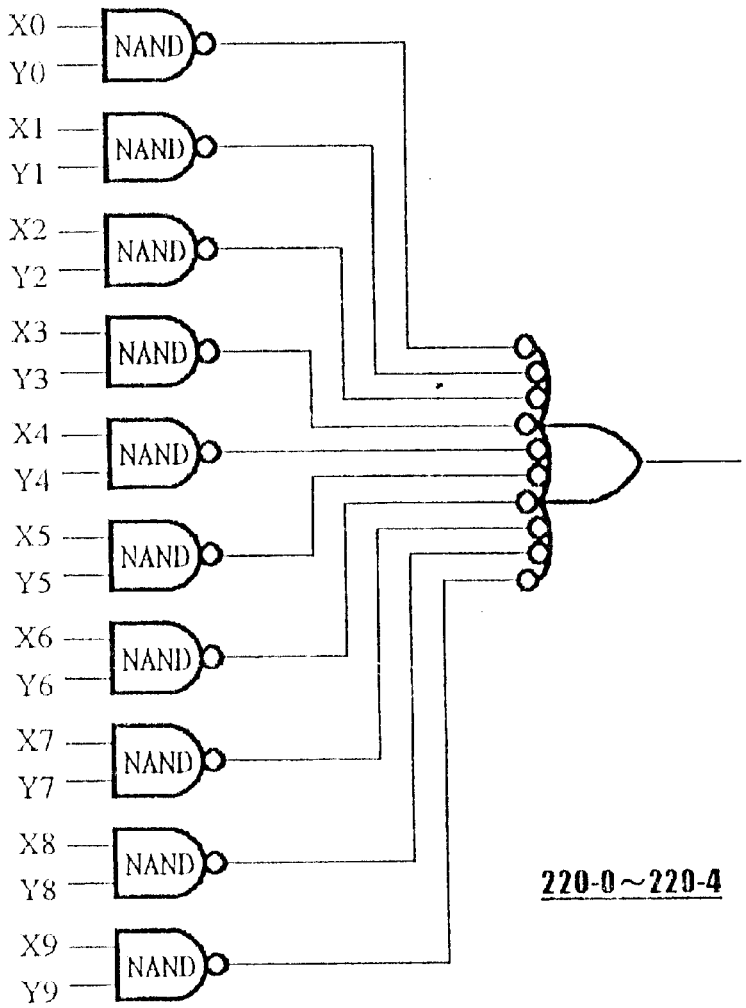
FIG. 9 is a diagram showing the arrangement of a selection switch.

Selection switches 220 (220-0 to 220-4) are circuits used instead of the PWM comparators 204, and are constituted by a plurality of logic gates, as is shown in FIG. 9. The individual bits of outputs Y9 to Y0 (Y9: MSB, and YO: LSB) of the gamma compensation setup register correspond to X9 to X0, and Xn is selected when Yn is 1. When, for example, Y9, Y8 and Y1 are 1 and all the other bits are 0, X9, X8 and X1 are simultaneously selected and merged. Then, at the succeeding step, the merged pulse sequence is transmitted to the D-FF 206.

Portions other than the pulse generator 222 and the selection switches 220 are the same as in the PWM system. In this system, since the frequency of the pulse sequences can be shifted to a high band, the resistance R and the capacitance C of the low-pass filter required for the PWM system can be reduced to approximately 1/10 those of the PWM system.

The results obtained by a simulation performed for the invention are shown in FIGS. 10 to 13.

Figure 10:
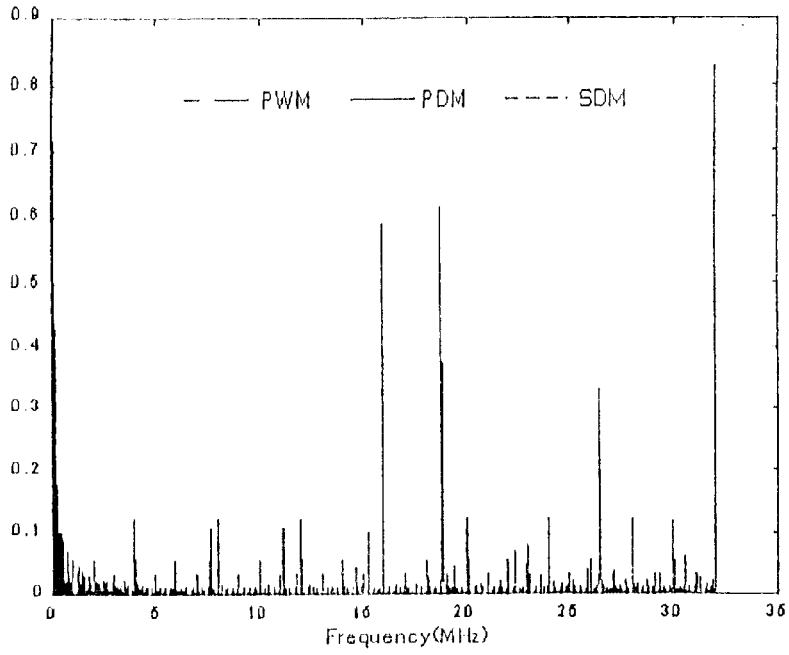
FIG. 10 is a first graph showing the results obtained by a simulation performed for the invention.

FIG. 10 is a graph showing the noise spectrum for each system when a 64 MHz system clock is used. Since the noise is shifted to a high band in the PDM and SDM systems, the low-pass filter RC that is set can be smaller than are those set for the PWM system.

Figure 11:
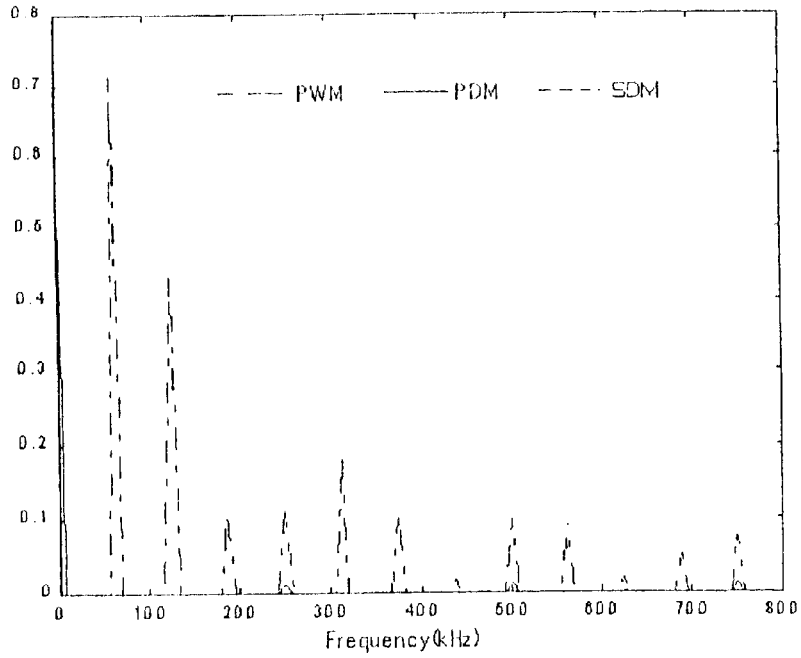
FIG. 11 is a second graph showing the results obtained by the simulation performed for the invention.

FIG. 11 is an enlarged graph showing a noise spectrum at 800 KHz or lower in FIG. 10.

Figure 12:
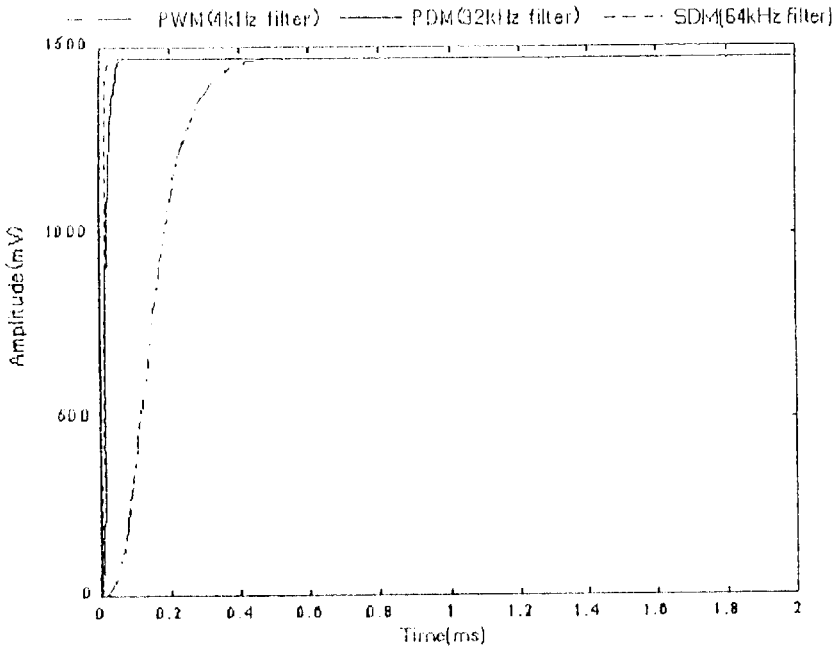
FIG. 12 is a third graph showing the results obtained by the simulation performed for the invention.

FIG. 12 is a graph showing the state that exists until the reference voltage is established.

Figure 13:
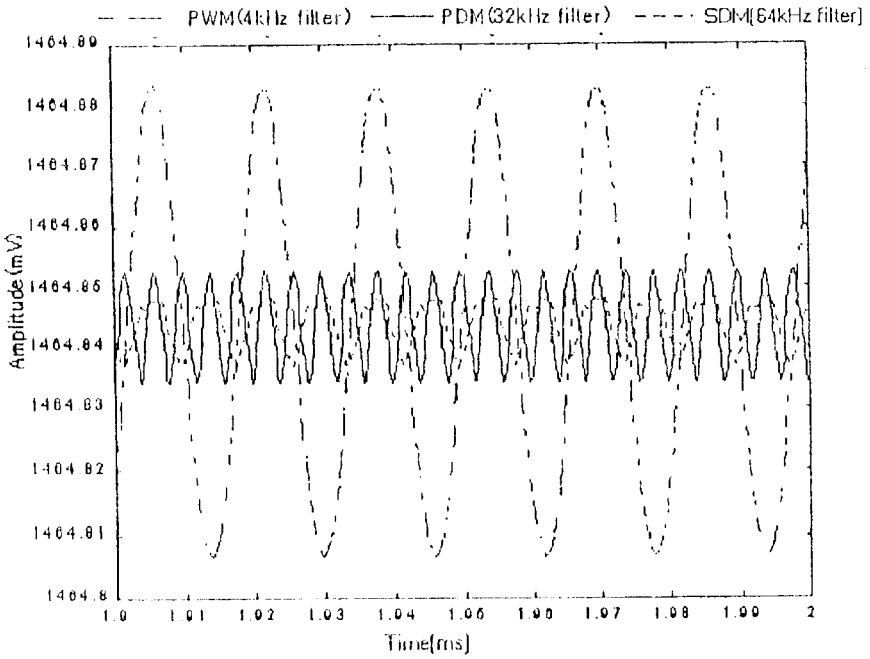
FIG. 13 is a fourth graph showing the results obtained by the simulation performed for the invention.

FIG. 13 is a graph showing the fluctuation of a reference voltage after it has been established. When the reference voltage has been established, fluctuation is suppressed so that for the PWM system it is 70 μV and for the PDM system it is 20 μV.

Figures 14, 15:
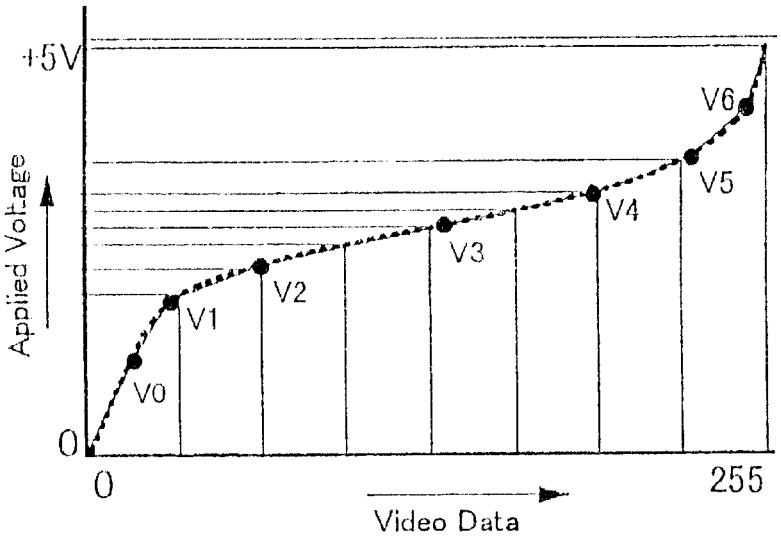
FIG. 14 is a graph showing an example gamma compensation function.
FIG. 15 is a diagram showing three control signals that are prepared for a common LCD source driver.

FIG. 14 is a graph showing an example gamma compensation function.

In FIG. 14, the broken line is a gamma compensation curve. When in accordance with this curve a voltage that corresponds to individual video data is obtained and is written to a liquid crystal, a linear scale is obtained. Actually, however, a line graph that approximates the gamma compensation curve is employed to determine the voltage that is to be written to the liquid crystal. In order to specify this line, the circuit of the invention generates a reference gamma compensation voltage. For an example wherein V0 (defined as 1 V) in FIG. 14 is generated at ±Vref0, (V0data=1024*1 [V]/5 [V]=204.8).

Therefore, when 205 (0011001101 in the binary system) is written in the ten bit wide register #0 (see FIG. 5), a voltage of 1.001 [V] is generated at ±Vref0. Generally, when binary data to be written is Gdata, the bit widths of the counter and the register are n bits, the liquid crystal drive voltage is Vlcd and the reference voltage is Vref, (Gdata=2^n*Vref/Vlcd) is established, and the gamma compensation data can be obtained.

As is shown in FIG. 15, three control signals (DIO, POL and STB) are prepared for a common LCD source driver. The signal DIO is a start signal for the sampling of video data; the signal POL is a signal for designating the polarity of the output of a driver; and the signal STB is a signal for the transmission of data from a video data register to a latch, and for starting the output to the liquid crystal.

In this example, of these signals, the signals DIO and STB are employed to write gamma compensation data in the ten bit wide register. The signal POL is employed unchanged, whereas generally, exclusive control of the signals DIO and STB is exercised, and a case is additionally provided wherein the signal STB is set High when the signal DIO is activated. When the input control circuit detects and identifies this state, it transfers the gamma compensation data to the shift register to the video bus.

Figure 16:
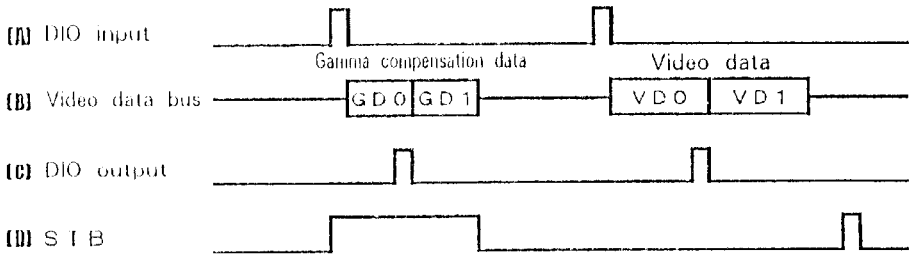
FIG. 16 is a timing chart for the control signals in FIG. 15.

The signal DIO is transmitted by cascade connections between the LCD source drivers, and the signal DIO that is to be output is activated upon receipt of the gamma compensation data. In other cases, normally, the data are transmitted to the video data register. This condition is shown in FIG. 16. In FIG. 16, to simplify the explanation only two LCD source drivers are employed.

As is shown in FIG. 16, the first LCD source driver receives the signal DIO while the signal STB is High, and then receives its own gamma compensation data GD0. The first driver then outputs the signal DIO at a timing whereby the cascade connection can be established. At this time, since the signal STB remains High, the second LCD source driver also receives its own gamma compensation data GD1. The second DIO input represents normal video input, and the transmission of the gamma compensation data is performed by the LCD controller after the power has been turned on. Furthermore, the LCD controller may begin the transmission of the gamma compensation data at an arbitrary time.

Figure 17:
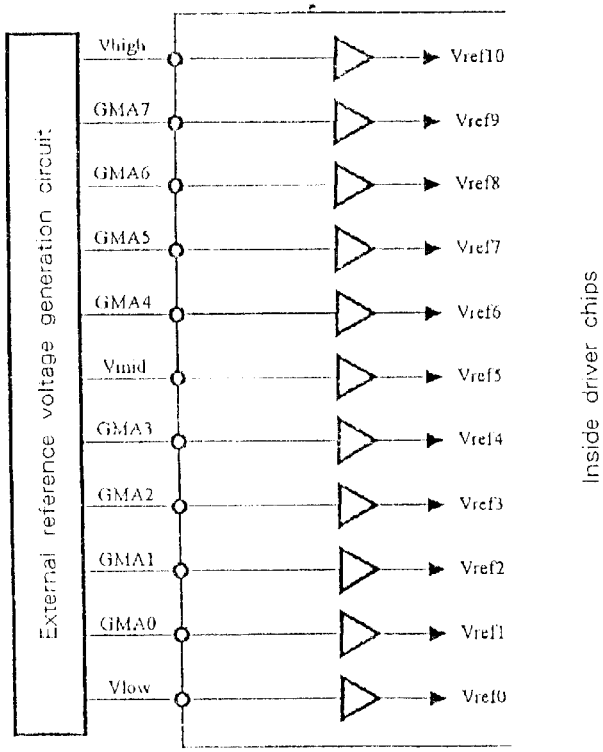
FIG. 17 is a diagram showing a first conventional method for generating a reference gamma compensation voltage.
Figure 18:
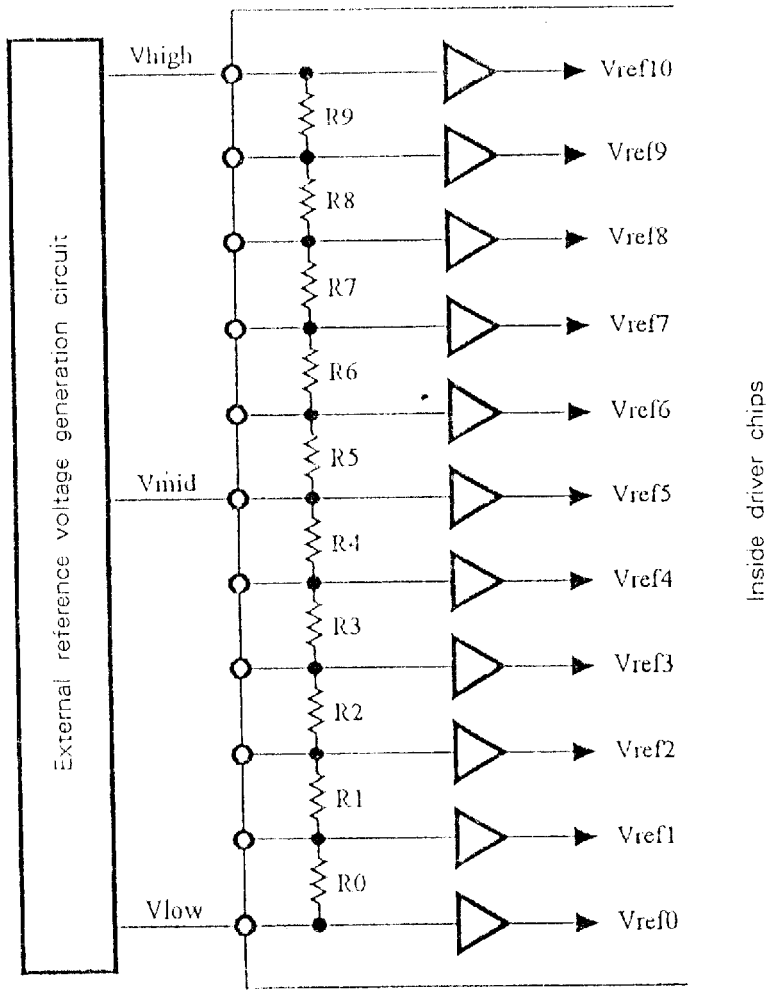
FIG. 18 is a diagram showing a second conventional method for generating a reference gamma compensation voltage.
Figure 19:
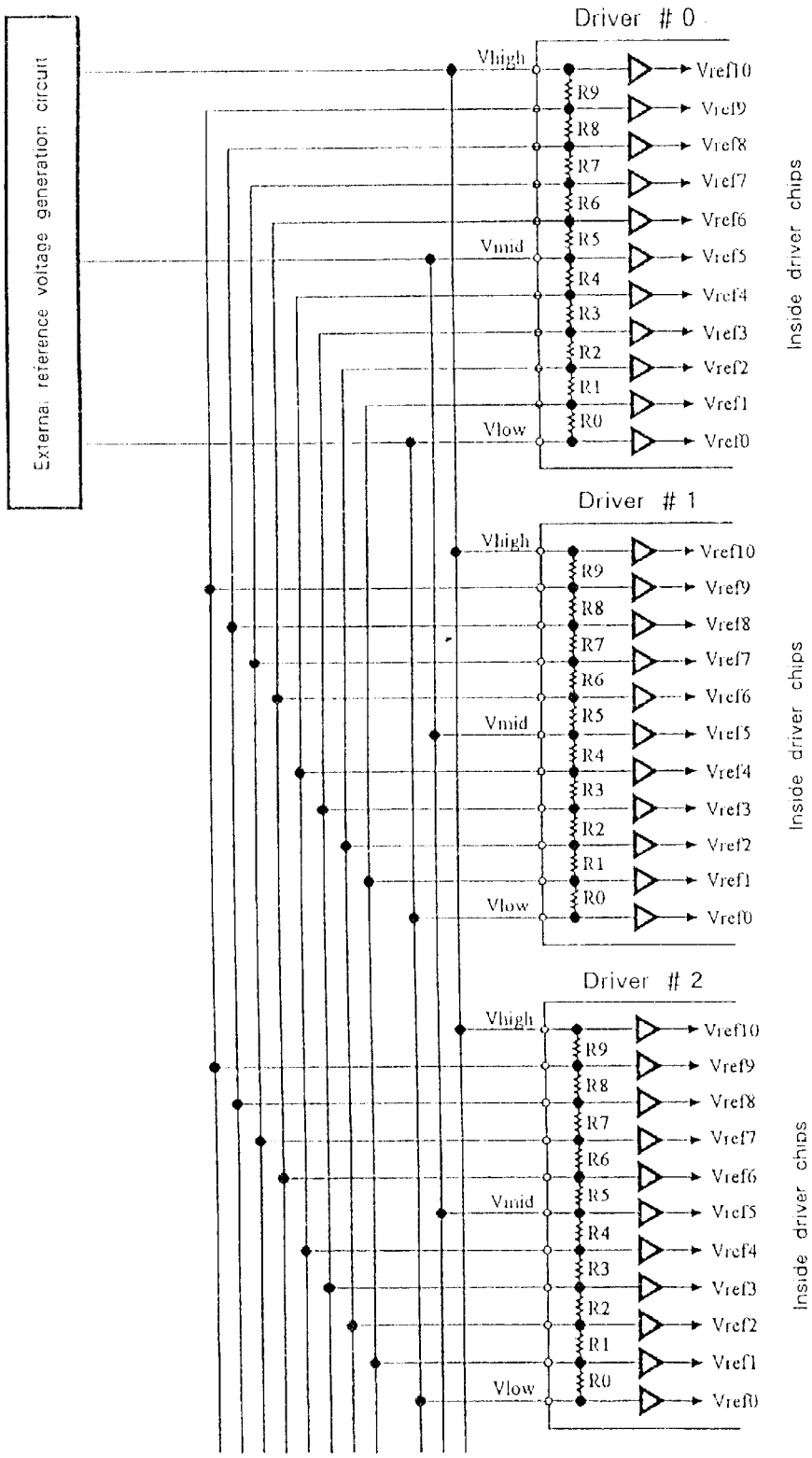
FIG. 19 is a diagram showing a third conventional method for generating a reference gamma compensation voltage.

When the LCD source driver 1 is thus arranged, the LCD source driver 1 internally generates a reference voltage, using a method that is unlike the conventional method as is shown in FIGS. 17 and 18 for generating a reference gamma compensation voltage, and transmits it to the driver chips. Thus, the reference voltage can be controlled in accordance with the pulse width and along the time axis of the generation count, so that number of variances occurring between the driver chips can be reduced.

Further, the LCD source driver 1 employs a reference voltage setting register and a pulse generator, which are internally provided, to generate a sequence of pulses that corresponds to the reference voltage, and to use the pulses to generate a direct-current voltage. Thus, the LCD source driver 1 can precisely generate a reference gamma compensation voltage, and is an appropriate driver for a Chip On Glass (COG) & Wiring On Array (WOA) LCD module.

Conventionally, ten reference voltages and three power inputs are required for gamma compensation. However, since the LCD source driver 1 of this invention internally generates a reference voltage, the power inputs required for gamma compensation can be reduced to merely three.

As is described above, according to the present invention, since the reference gamma compensation voltage generation circuit internally generates a reference gamma compensation voltage, the number of inputs to the LCD driver chip can be reduced. Further, even when a plurality of LCD driver chips are employed, the number of variances occurring between the LCD driver chips can be reduced.

While the invention has been particularly shown and described with respect to preferred embodiments thereof, it will be understood by those skilled in the art that the foregoing and other changes in form and details may be made therein without departing form the spirit and scope of the invention.

Having thus described our invention, what we claim as new, and desire to secure by letters patent is:

1. A reference gamma compensation voltage generation circuit comprising:

a counter, for system clocks, that generates a clock count values;

a register for storing a set gamma compensation function value;

signal generation means for receiving clock values from the counter and for receiving the compensation function value from the register, and including a comparator for repeatedly comparing clock values from the counter with the compensation function value from the register, and to generate, on the basis of said comparison, a pulse width modulation (PWM) signal wherein, for each gamma compensation cycle, said gamma compensation function value is represented as a pulse width; and a voltage generation circuit for employing said PWM signal to generate a reference gamma compensation voltage.

2. The reference gamma compensation voltage generation circuit according to claim 1, wherein said signal generation means compares said clock count value with said gamma compensation function value to generate said PWM signal.

3. The reference gamma compensation voltage generation circuit according to claim 1, wherein said voltage generation circuit filters said PWM signal to generate said gamma compensation function value.

4. A reference gamma compensation voltage generation circuit comprising:

a counter for generating a count value that represents a gamma compensation cycle;

a register for storing a set gamma compensation function value;

signal generation means for receiving the count value from the counter and for receiving the compensation function value from the register, and including a comparator for repeatedly comparing count value from the counter with said gamma compensation function value from the register, and to generate on the basis of said comparison, a pulse density modulation (PDM) signal that represents said gamma compensation function value as the number of pulses for each gamma compensation cycle; and a voltage generation circuit for employing said PDM signal to generate a reference gamma compensation voltage.

5. The reference gamma compensation voltage generation circuit according to claim 4, wherein said voltage generation circuit filter said PDM signal to generate said gamma compensation function value.

* * * * *